United States Patent [19]

Bschorr

[11] 4,149,612

[45] Apr. 17, 1979

[54] NOISE REDUCING RESONATOR APPARATUS

[75] Inventor: Oskar Bschorr, Munich, Fed. Rep. of Germany

[73] Assignee: Messerschmitt-Boelkow-Blohm GmbH, Munich, Fed. Rep. of Germany

[21] Appl. No.: 812,617

[22] Filed: Jul. 5, 1977

[30] Foreign Application Priority Data

Jul. 17, 1976 [DE] Fed. Rep. of Germany ..... 2632290

[51] Int. Cl.[2] ..... G10K 11/10

[52] U.S. Cl. ..... 181/286; 181/295

[58] Field of Search ..... 181/284, 286, 287, 288, 181/291, 294, 295, 296, 129

[56] References Cited

U.S. PATENT DOCUMENTS

| | | | |
|---|---|---|---|
| 2,153,357 | 4/1939 | Wente | 181/291 |
| 2,502,017 | 3/1950 | Beers | 181/295 |
| 2,502,018 | 3/1950 | Olson | 181/295 |
| 2,502,019 | 3/1950 | Olson | 181/295 |
| 2,840,179 | 6/1958 | Junger | 181/286 |
| 3,117,575 | 1/1964 | Carrell | 181/129 |

FOREIGN PATENT DOCUMENTS

| | | | |
|---|---|---|---|
| 102914 | 1/1938 | Australia | 181/295 |
| 12357 | 7/1956 | Fed. Rep. of Germany | 181/295 |
| 2235452 | 1/1974 | Fed. Rep. of Germany | 181/295 |
| 746949 | 3/1956 | United Kingdom | 181/295 |

*Primary Examiner*—Nicholas P. Godici

*Attorney, Agent, or Firm*—W. G. Fasse; W. W. Roberts

[57] ABSTRACT

The present noise reducing apparatus includes resonators which have a small and variable volume as well as a high admittance. For this purpose the resonators constitute vibrating systems having at least one volume wherein the pressure is reduced below atmospheric pressure to provide a reduced volume stiffness. The volume is confined by wall elements having a very small or a negative spring rate under reduced pressure inside said volume.

15 Claims, 8 Drawing Figures

Fig.1
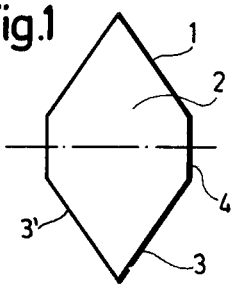
Fig.2
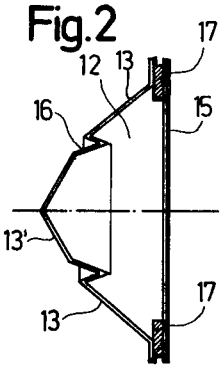
Fig.3b
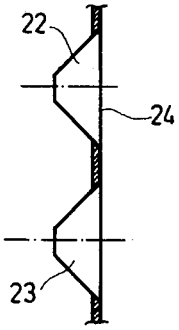
Fig.4
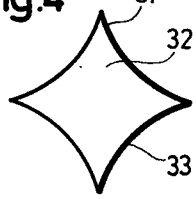
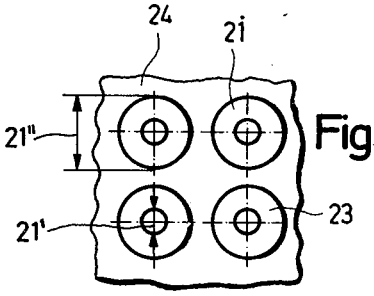
Fig. 3a
Fig.5
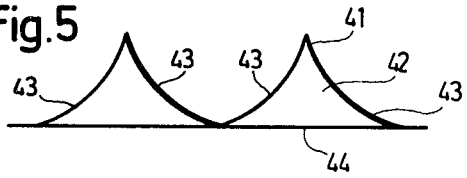
Fig.6a
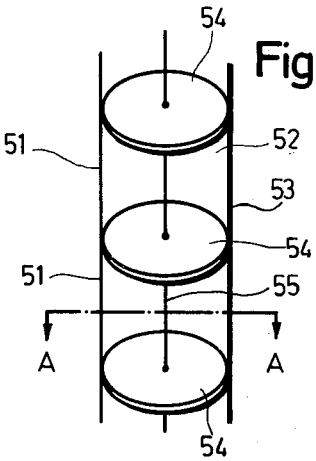
Fig.6b
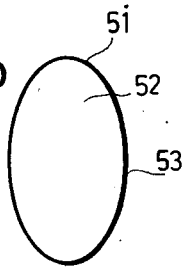

NOISE REDUCING RESONATOR APPARATUS

BACKGROUND OF THE INVENTION

The present invention relates to noise reducing resonator devices having a relatively small structural volume which is variable and which has a high admittance. Such devices are suitable for reducing the noise pollution in the air and other gaseous, vaporous and liquid media.

The reduction of noise is part of the protection of our environment and constitutes a foremost problem especially with regard to the reduction of noise in workshops, offices, and the like. Many possibilities are available for the noise reduction. However, economical and technical considerations frequently prevent the use of known devices for the intended noise reduction purpose.

It has been suggested to reduce noise by means of destructive interference, please see "Journal of Sound and Vibration", 1970, Nr. 2, pages 223 - 233, by Czarnecki. According to this prior art it is suggested using so-called Helmholtz resonators located near a source of noise which excites the resonators to oscillate in phase opposition thereby contributing to an interference quenching of the noise. This effect may be interpreted as a mismatching of the radiation resistance due to the resonators. Yet another interpretation based on multipole analysis suggests that the source of noise which originally operates as a monopole, is transformed into a pole of higher order having a lower operational efficiency.

Helmholtz resonators are frequently used in connection with sound absorbers or dampers. The circuit arrangment may be a series connection or a parallel connection, whereby sound absorbing or damping and sound insulation may be accomplished. As such, Helmholtz resonators are simple and very efficient structural elements. However, the disadvantage resides in the fact that these resonators require a large structural volume in the lower frequency range. On the other hand, a Helmholtz resonator has a relatively narrow frequency band or range in which it operates efficiently. Thus, due to the required volume it is not always possible to utilize several, differently tuned Helmholtz resonators.

On the other hand, well known mechanical resonators, for instance, plates oscillating along with the noise source have an input impedance which is too high, in other words, their admittance is too low so that they are efficient only where a large surface area may be exposed to the sound or noise to be reduced.

OBJECTS OF THE INVENTION

In view of the foregoing, it is the aim of the invention to achieve the following objects, singly or in combination:

to construct variable volume resonators which in addition have a small structural volume and a high admittance;

to provide sound reducing devices which may be arranged in any desired pattern or configuration, such as a line arrangement or a surface arrangement;

to provide a sound reducing device which may equally be used at the source of the noise or sound as well as at the point where the noise or sound is received; and to provide devices for the reduction of sound or noise which can be employed as sound insulating means as well as, or in the alternative, as sound damping means.

SUMMARY OF THE INVENTION

According to the invention, there is provided a noise reducing device including a variable volume resonator or resonators having a small structural volume and a high admittance, wherein wall elements confine a volume which is evacuated to a reduced pressure below atmospheric pressure to provide a reduced volume stiffness. At such reduced pressure the wall elements have a very small positive or even a negative spring rate within the range of −500 N/cm up to +100 N/cm. The wall elements are so dimensioned as to just take up the force difference between the outer and inner pressure. Due to the low spring rate as taught herein, it has become possible to realize small volume resonators even for the low frequency range. Another advantage is seen in that due to the small spring rate of the wall elements, the mass of these wall elements can be reduced accordingly so that the admittance is increased. It has been found that so-called Belleville or cup springs are especially suitable for the purposes of the invention since the spring rate of this type of spring diminishes in response to an increasing load and may even become negative.

According to a further embodiment of the invention, the volume of the noise reducing device has an oval configuration surrounded by wall means having a low mass but being stiff relative to shearing forces. Such volume includes a pressure corresponding to atmospheric pressure. The volume variability and the volume stiffness is achieved in this embodiment by the deformation of the oval configuration while maintaining the circumferential length due to the stiffness against shearing loads. A circular configuration has a larger surface area than an oval while having the same circumferential length. The volume confining walls of the device constitute the mass of such a resonator.

The present volume variable resonators may be utilized substantially in the same manner as Helmholtz resonators, however, with the added advantage that due to the small structural volumes additional ways of using such resonators have been opened up. Thus, it is now possible, for example, to combine a plurality of differently tuned resonators for reducing a wide frequency range of different noises or sounds. Where such a set of resonators or combination of resonators is used at the source of the noise an emission reduction is accomplished due to a mismatching. Where the resonators or sets of resonators are utilized at the point of sound reception a noise reduction is also accomplished as a result of a mismatching. Another advantage of the present resonators is seen in that they may be arranged in any configuration, for example, they may be arranged in a row to form a curtain of resonators in strip form. Thus, for example, open windows may be provided with a noise insulating curtain made up such strips of resonators. Furthermore, the present resonators are also well suitable for covering surface areas or surface configurations.

The band widths of the present resonators may be increased by damping means known as such. Basically, the present resonators act as a noise insulation. However, the resonators of the invention are equally suitable for noise damping by oscillating in phase opposition to the phase of the noise to be dampened.

BRIEF FIGURE DESCRIPTION

In order that the invention may be clearly understood, it will now be described, by way of example, with reference to the accompanying drawings, wherein:

FIG. 1 illustrates a resonator according to the invention made up of so-called Belleville springs confining a volume in which a reduced pressure is maintained;

FIG. 2 shows a sectional view through a further embodiment of the invention wherein the resonator comprises two stages including two Belleville spring wall members confining a volume with reduced pressure therein;

FIG. 3*a* illustrates a plurality of Belleville spring resonators arranged in a surface configuration and having a reduced pressure in each resonator volume;

FIG. 3*b* illustrates a side view of several Belleville spring resonators arranged in a row and also having a reduced pressure in the resonator volumes;

FIG. 4 illustrates a reduced pressure volume resonator, the walls of which are made of Euler type buckling strips;

FIG. 5 illustrates a side view of resonators similar to that of FIG. 4, but arranged in a row, whereby such resonators may also be arranged in a surface configuration with several rows positioned side by side;

FIG. 6*a* illustrates a plurality of resonators having an oval volume configuration and walls with a high stiffness against shearing forces, whereby the resonators are arranged in a row or in a strip form; and FIG. 6*b* illustrates a sectional view along section line A—A in FIG. 6*a*.

DETAILED DESCRIPTION OF PREFERRED EXAMPLE EMBODIMENTS

FIG. 1 illustrates an example embodiment of a volume variable resonator 1 comprising two Belleville springs 3 and 3' as well as sealing discs 4 confining a volume 2. The pressure in the volume 2 is reduced to a pressure below atmospheric pressure, whereby the reduced pressure is selected relative to the Belleville springs 3, 3' in such a manner that the Belleville springs are loaded in the flat or negative range of their spring characteristic or spring rate curve. This feature of the invention has the advantage that a low total spring deflection is accomplished which in turn results in a desirably small volume even for low resonance frequencies.

Incidentally, the present resonators may be made, for example, of the following materials: steel, duraluminium, titanium, magnesium. This list is not intended to be complete.

The resonator of FIG. 2 is constructed substantially in a similar manner as the resonator of FIG. 1. However, in FIG. 2 the two Belleville springs 13 and 13' are connected to each other by means of an expansion gap 16 which in fact decouples the two springs from each other in an oscillator sense. The Belleville spring 13 is secured to a base plate or back wall 15 by means of a layer or ring 17 of plastic damping material such as . The volume 12 confined by the just described elements is also under reduced pressure. Due to the expansion gap 16, it is possible to realize two resonance frequencies. The springs 13 may also be directly connected to the back wall 15. However, a controlled damping may be accomplished by the damping layer or ring 17. Instead of using two Belleville springs in a two-stage configuration as shown in FIG. 2, it is also possible to employ a larger number of Belleville springs in an analog manner, each having its respective resonance frequency.

FIG. 3*a* illustrates a plan view of a plurality of resonators 21 comprising Belleville springs 23 secured to a back wall 24 also shown in FIG. 3*b*, thereby confining volumes 22 under reduced pressure. The resonators 21 are arranged in rows and columns to form a surface configuration. FIG. 3*b* is a side view of the arrangement of FIG. 3*a*. If it is intended to reduce a wide frequency range of noise signals, it is advantageous to tune the individual resonators 21 to different frequencies. Several parameters or factors may be employed for such tuning. For example, the resonance frequency of the individual resonators 21 may be influenced by the material of which the Belleville springs are made, by the material thickness, by the inner diameter 21' as well as by the outer diameter 21'' and by the size of the reduced pressure inside the individual volumes 22.

FIG. 4 illustrates a further basic element of a resonator 31 comprising four strips 33 constituting the lateral boundary of a prismatic volume 32 which is closed by top and bottom elements having the configuration shown in the top plan view of FIG. 4. The volume 32 is evacuated and due to the reduced pressure inside the volume 32 the strips 33 are buckling inwardly. When the load on the strips 33 exceeds the so-called Euler buckling load, the strips 33 have a very small spring rate or constant. As a result, and in combination with the reduced pressure, a low volume stiffness of the volume 32 is accomplished, whereby the resonators may be constructed to have very small dimensions.

FIG. 5 illustrates a resonator structure similar to that of FIG. 4. The resonators 41 of FIG. 5 may be combined into a strip or surface configuration, whereby again rows and columns may be employed. Each resonator 41 has a volume 42 confined by two strips 43 and a back wall 44. The function of the arrangement of FIG. 5 is analog to that of FIG. 4.

FIG. 6*a* illustrates a strip arrangement of resonators 51, whereas FIG. 6*b* illustrates a sectional view along section line A—A of FIG. 6*a* with a deformation of the cross-sectional area. A resonator 51 comprises a prismatic volume 52 having an oval cross-sectional area. The volume 52 is confined at the upper and lower ends by separator discs 54. The walls 53 of the resonator 51 are made of relatively thin material which has nevertheless a high resistance against shearing. Such material may, for example, be plastics, rubber etc. The volume 52 confines a reduced pressure below atmospheric pressure. The resonator itself is formed by the mass of the walls 53 and the volume stiffness of the oval shape. Due to the shearing resistance of the walls 53 a volume variation is accomplished by deforming the oval configuration, whereby the circumferential length remains constant. An oval shape having an almost circular cross-sectional area has a larger volume than an elongated oval shape as shown in FIG. 6*b*. Thus, where a noise or sound wave produces a gauge pressure peak, the resonator of this type will reduce its volume by becoming more eccentric whereas a volume increase is accomplished in response to a reduced pressure, whereby the oval form approximates almost a circular cross-sectional area. As a result of these volume variations, the wall 53 performs an oscillatory motion comparable to that of a quadrupole. The resulting effective force is reduced in this connection because of the simultaneously occurring negative and positive normal movements of the wall. As a result, the resonators 51 require larger exposed surface areas. To this end the resonators 51 are arranged or rather combined into line shaped units, whereby a plurality of individual resonators 51 may be secured to a wire 55 running centrally through each of the separator discs 54 which are secured to the wire 55. Further, the individual resonators 51 of the line unit are tuned to different frequencies in order to achieve the desired broad frequency response characteristic. The wire 55 takes up the tension loads to which such a line unit may be subject in use.

By arranging the resonators of the invention in a surface configuration, it is possible to realize noise absorbing walls having a small structural thickness or depth. For this purpose it is advantageous to arrange a noise absorbing material immediately in front of the resonator surface. A reflection is caused by the resonator surface at the free end, that is, the reflection takes place at high acoustic velocity. Therefore, the sound or noise absorbing material is located in the optimal range of acoustic velocity. On the other hand, where a rigid wall is involved providing a non-absorbing or rigid reflection, the normal component of the acoustic velocity is zero, whereby a respectively increased spacing of the noise absorbing material from the wall is required.

It has been found to be advantageous to space the individual resonators from each other by a spacing corresponding to the wave length of the noise to be reduced, where the individual resonators are all tuned to the same frequency and where the resonators are arranged in a line or surface configuration. Local dipole systems are formed because a reflection occurs in the range of the resonators at the free end with a phase shift of 180° and because the reflection in the intermediate range takes place without a phase shift. As a result, the direction of noise propagation are redistributed. Where noise absorbing material such as a blanket is employed as described high damping values are obtained due to the large acoustic velocity fields or dipole systems.

Where two or multi layer separation walls are used, it is advantageous to arrange the present resonators in the space between adjacent layers, whereby the resonators are preferably tuned to the resonance frequency of the separation wall. In this manner it is possible to eliminate or at least shift the vibrating of the wall at resonance into a lower frequency range.

Although the invention has been described with reference to specific example embodiments, it will be appreciated, that it is intended to cover all modifications and equivalents within the scope of the appended claims.

What is claimed is:

1. A noise reducing apparatus comprising resonator means having a variable, sealed volume and wall means defining said variable, sealed volume, a reduced pressure confined in said volume, said reduced pressure being below atmospheric pressure, said wall means having a spring rate ranging from small positive values to negative values in response to said reduced pressure inside said sealed volume, whereby a high admittance is achieved, and wherein said sealed volume confining wall means comprise so-called Belleville spring means.

2. The apparatus of claim 1, wherein said volume confining Belleville spring means are constructed to convey shearing forces, said resonator means comprising an inner volume of prismatic shape and of an oval cross-section confined by said wall means.

3. The apparatus of claim 1, wherein said Belleville spring means comprise spring members of which at least two spring members are arranged adjacent to each other, said apparatus further comprising junction means operatively connecting adjacent spring members to each other.

4. The apparatus of claim 1, wherein said resonator means comprise a plurality of individual resonator members tuned to different frequencies and arranged in sets at the location where noise is to be reduced, whereby the noise reduction is accomplished over a wide band of frequencies as determined by the total frequency range of said resonator members.

5. The apparatus of claim 4, wherein the individual resonator members are arranged in a row.

6. The apparatus of claim 6, wherein the individual resonator members are arranged to cover a surface to form a noise reducing curtain.

7. The apparatus of claim 7, further comprising sound absorbing material surrounding said individual resonator members.

8. The apparatus of claim 1, wherein said resonator means comprise a plurality of individual resonator members all of which are tuned to the same frequency, said resonator members being spaced from each other at intervals corresponding in length to the wave length of the noise to be reduced whereby the directional distribution of the noise or sound may be varied.

9. A noise reducing apparatus comprising resonator means having a variable, sealed volume and wall means defining said variable, sealed volume, a reduced pressure confined in said volume, said reduced pressure being below atmospheric pressure, said wall means having a spring rate ranging from small positive values to negative values in response to said reduced pressure inside said sealed volume, whereby a high admittance is achieved, and wherein said sealed volume confining wall means comprise a plurality of Euler type buckling strip means.

10. The apparatus of claim 9, wherein said volume confining Euler type buckling strips are constructed to convey shearing forces, said resonator means comprising an inner volume of prismatic shape and of an oval cross-section confined by said wall means.

11. The apparatus of claim 9, wherein said resonator means comprise a plurality of individual resonator members tuned to different frequencies and arranged in sets at the location where noise is to be reduced, whereby the noise reduction is accomplished over a wide band of frequencies as determined by the total frequency range of said resonator members.

12. The apparatus of claim 11, wherein the individual resonator members are arranged in a row.

13. The apparatus of claim 11, wherein the individual resonator members are arranged to cover a surface to form a noise reducing curtain.

14. The apparatus of claim 11, further comprising sound absorbing material surrounding said individual resonator members.

15. The apparatus of claim 9, wherein said resonator means comprise a plurality of individual resonator members all of which are tuned to the same frequency, said resonator members being spaced from each other at intervals corresponding in length to the wave length of the noise to be reduced whereby the directional distribution of the noise or sound may be varied.

* * * * *

UNITED STATES PATENT OFFICE

CERTIFICATE OF CORRECTION

Patent No. 4,149,612 Dated April 17, 1979

Inventor(s) Oskar Bschorr

It is certified that error appears in the above-identified patent and that said Letters Patent are hereby corrected as shown below:

In column 6, line 16, "claim 6" should be --claim 4--.

In column 6, line 19, "claim 7" should be --claim 4--.

Signed and Sealed this

Sixth Day of November 1979

[SEAL]

Attest:

RUTH C. MASON
Attesting Officer

LUTRELLE F. PARKER
Acting Commissioner of Patents and Trademarks